United States Patent [19]

Suuronen et al.

[11] Patent Number: 4,946,086

[45] Date of Patent: Aug. 7, 1990

[54] METHOD AND APPARATUS FOR SEVERING A PAPER WEB, PARTICULARLY PERFORATED PAPER

[75] Inventors: Lasse Suuronen, Järvenpää ; Teuvo Lappalainen, Kerava; Pentti Harakka, Järvenpää, all of Finland

[73] Assignee: Valmet Paper Machinery Inc., Heksinki, Finland

[21] Appl. No.: 214,440

[22] Filed: Jul. 1, 1988

[30] Foreign Application Priority Data

Jul. 3, 1987 [FI] Finland ..... 872965

[51] Int. Cl.[5] ..... B26F 3/02; B65H 35/10

[52] U.S. Cl. ..... 225/4; 225/93; 225/100; 225/105

[58] Field of Search ..... 225/2, 4, 93, 100, 101, 225/104, 105, 106; 493/474

[56] References Cited

U.S. PATENT DOCUMENTS

| | | | |
|---|---|---|---|
| 3,615,047 | 10/1971 | Feldman et al. | 225/93 |
| 3,794,228 | 2/1974 | Colwill et al. | 225/105 |
| 3,863,821 | 2/1975 | Van Bennekom | 225/101 |

*Primary Examiner*—Hien H. Phan

[57] ABSTRACT

A method and an apparatus for severing a perforated web involves clamping the web (4) by two clamping members (6, 7) extending essentially transversely over the web (4) against an anvil (1) placed on the opposite side of the web (4) so as to leave a perforated line (5) of the web aligned between the clamping members (6,7). The clamped web is then tensioned by allowing a tensioning member (2) located between the clamping members (6,7) to expand toward a backing bight (20, 21) formed behind the web (4) thus causing the web (4) to be severed at the perforation (5) with the help of tensile stress.

17 Claims, 2 Drawing Sheets

METHOD AND APPARATUS FOR SEVERING A PAPER WEB, PARTICULARLY PERFORATED PAPER

The present invention relates to a method for severing a paper web by clamping and aligning the web and placing the web in tension.

DESCRIPTION OF THE BACKGROUND ART

The invention also concerns an apparatus for the implementation of the method.

The increase in the number of computer applications has an impact on the growing use of perforated paper. The paper is conventionally packed into bunches of fan-folded continuous forms with the paper being perforated at the folds. The paper is fed into a printing machine or printer, after which operation the web is cut into sheets of desired length appropriate with the application.

Up to now, the perforated paper has been ripped, for example, by manual methods without auxiliary tools. Cutting has also been effected using a serrated blade, having a width extending at least over the entire width of the paper web, against which the web is pressed manually or with a mechanical accessory. Alternatively, shearing devices are conventionally used, thereby achieving a neat cutting edge on an unperforated web.

A disadvantage of conventional technology is that the nonshearing severing devices do not always manage to cut the paper at a desired point, thus resulting in an unsatisfactory quality of the separated edge. Shearing devices are hampered by their complicated construction, which results in higher manufacturing and service costs.

SUMMARY OF THE INVENTION

The aim of the present invention is to overcome the disadvantages associated with the prior art technology and achieve a totally new kind of method and apparatus for severing a paper web.

The invention is based on severing the paper web, which is held by clamping means, with the help of tensioning exerted on the web by a severing means placed between the clamping means.

More specifically, the method in accordance with the invention is characterized by clamping the web with two clamping members to align it therebetween and tensioning the web by a tensioning member between the clamping members to separate the web at a perforation with the help of tensile stress.

Furthermore, the apparatus in accordance with the invention is characterized by two clamping members aligned transversely to the web movement direction, an anvil on the opposite side of the web from the clamping member, a tension means for severing the web and a backing bight.

The invention provides outstanding benefits.

The severing process in accordance with the invention results in an accurate separation of the web at the perforation, provided that the perforation line falls between the bounds of the clamping means. However, the distance between the clamping means is large allowing a wide latitude in the alignment of the web. The implementation of the invention requires no cutting blades nor mechanically wearing parts. Further, paper litter produced in a shearing operation is avoided. Moreover, the method is relatively quiet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is next examined in detail with help of the following exemplifying embodiments illustrated in the attached drawings which are given by way of illustration only, and thus are not limitative of the present invention, and wherein.

DETAILED DESCRIPTION OF THE PREFERRED EMBODIMENTS

Figure 1:
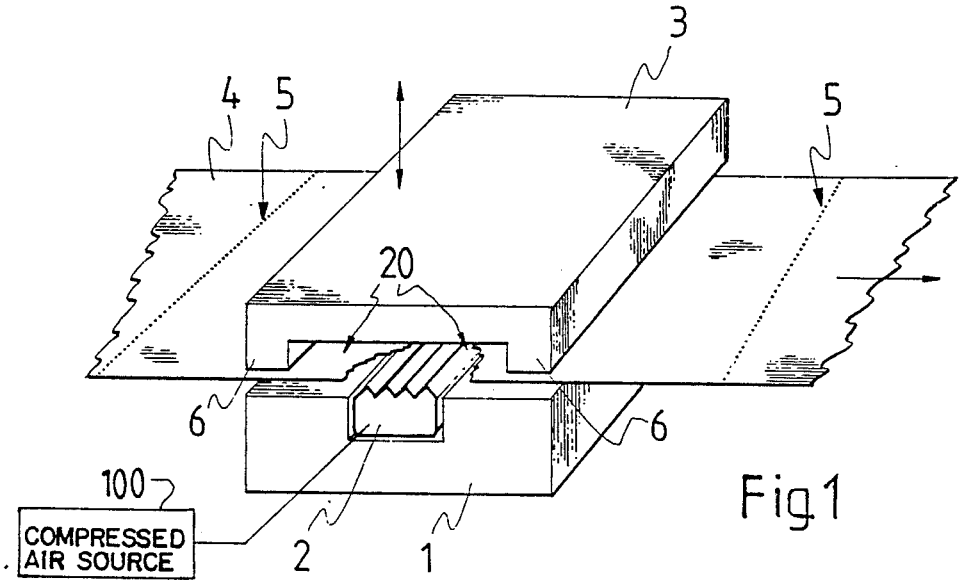
FIG. 1 is a perspective view of a paper web severing apparatus in accordance with the invention.

Illustrated in FIG. 1 is a possible implementation of the severing apparatus. The apparatus comprises a plate-formed anvil 1, whose width extends at least over the width of a paper web 4. The upper surface of the anvil is essentially parallel with the web 4. The upper surface of the anvil 1 is designed to incorporate a channel aligned cross-wise to the direction of the paper web to accept a tensiong hose 2. Above the anvil 1 a pressing shoe 3 is positioned. The distance between the pressing shoe 3 and the web 4 is adjustable by actuator means (not shown). The width of the pressing shoe 3 is at least as wide as that of the web 4. The lower surface of the pressing shoe 3 has two clamping members 6, extending cross-wise over the web so that a backing bight 20 is formed between them. The clamping members 6 are placed to be appropriately spaced from the tensioning hose 2 and mate over their full length with the upper surface of the anvil 1 when the shoe 3 is pressed against the anvil. A proper distance between the tensioning hose 2 and the clamping member 6 is the diameter of the hose, for example. The distance may be varied from 0.5 to 1.5 times the hose diameter.

Severing operation of the web is effected in the apparatus by guiding the paper web 4 between the anvil 1 and the pressing shoe 3. The web 4 moves cyclically stepeed or in a continuous movement in the direction indicated by the arrow. When a desired perforation line 5 is aligned between the clamping members 6, the pressing shoe 3 is pushed down to mate with the anvil 1 so as to clamp the web to the anvil on either side of the tensioning hose 2 by means of the clamping members 6. Then, compressed air is, released by compressed air source 100 into the hose making the hose expand and exert tension on the web 4 causing the web to be severed at the perforation 5. The pressing shoe 3 is retracted upwardly, pressure is released from the hose, and the severed paper sheet is withdrawn with the help of a pulling device (not shown) while the feed of the paper web 4 is continued from the printer. Removal of the severed sheet may also be implemented with the help of an air jet or gravity.

Figure 2:
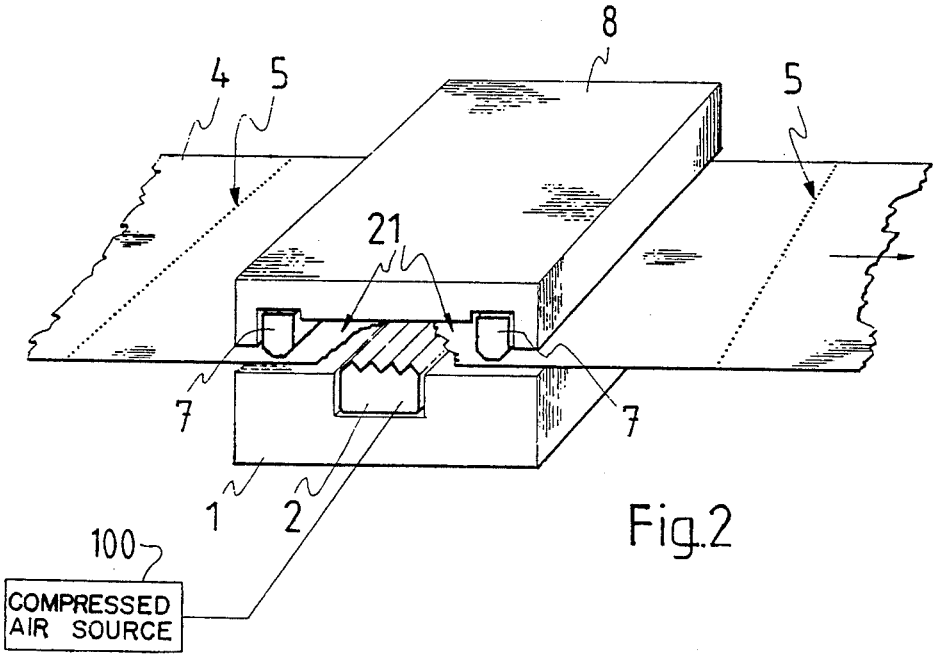
FIG. 2 is a perspective view of a second paper web severing apparatus in accordance with the invention.

In the embodiment illustrated in FIG. 2., an upper part 8 is permanently mounted above the anvil 1 carrying clamping hoses 7 on its lower surface with a comparable function as the clamping members 6 shown in FIG. 1. The placement of these clamping members is comparable to that of the clamping members 6 shown in FIG. 1. Correspondingly, this embodiment also provides a backing bight 21 formed between the clamping hoses 7. Severing is achieved by applying pressure to the clamping hoses 7 when the desired separation line 5 falls between the hoses, thereby clamping the paper web to the anvil 1 at both sides of the severing hose 2. An instantaneous pressurization of the severing hose 2 tensions the paper web causing its separation at the perforation 5. Then, pressure is released from the clamping hoses 7 to allow further feeding of the web.

Figure 3:
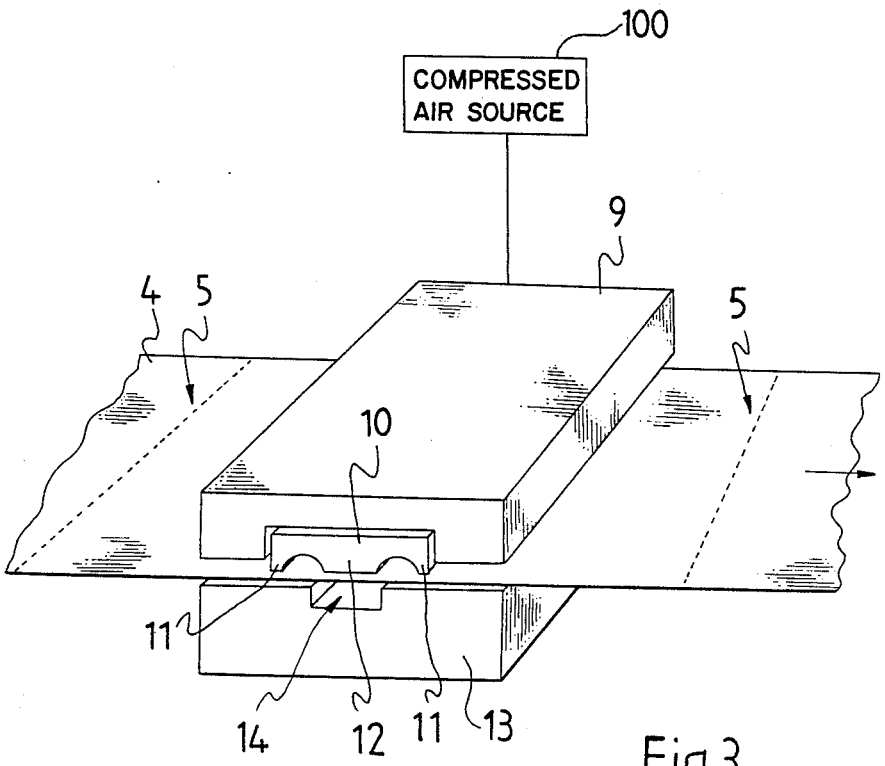
FIG. 3 is a perspective view of third paper web severing apparatus in accordance with the invention.

In the embodiment illustrated in FIG. 3., the severing apparatus comprises a stationary upper part 9 having a wide compressed air hose 10 mounted in a channel extending over the web 4. The hose has two functional parts, namely clamping sections 11 at the rims of the hose 10 and a severing section 12 in the middle of the hose. A lower part 13 of the apparatus comprises backing bight 14, aligned to coincide with the severing section 12 with a width exceeding that of the severing section. When the hose 10 is pressurized, the clamping sections 11 press the web 4 against the lower part 13 while the severing section 12 performs a severing operation of the web while expanding down into the backing bight 14.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for severing a perforated web comprising the steps of:

providing two clamping members, an anvil and an inflatable tensioning member, the tensioning member being positioned between the two clamping members;

passing the web between the two clamping members and the anvil, said two clamping members being positioned generally transverse to a direction of movement of the web;

moving the two clamping members into engagement with the web to clamp the web against the anvil; and inflating the tensioning member to thereby expand and contact the web proximate a perforation thereof to thereby sever the web, said tensioning member only severing the web at the perforation thereof when being inflated.

2. The method for severing a perforated web as recited in claim 1, further comprising the steps of:

providing a backing bight on a side of the web opposite to the tensioning member; and moving the tensioning member toward the backing bight during the inflating.

3. The method for severing a perforated web as recited in claim 1, further comprising the step of providing a flexible hose as the tensioning member.

4. The method for severing a perforated web as recited in claim 1, wherein the step of moving the two clamping members further comprises the step of shifting two rigid members forming the two clamping members toward the web.

5. The method for severing a perforated web as recited in claim 1, wherein the step of moving the two clamping members further comprises the step of inflating two hoses forming the two clamping members whereby said hoses move toward the web.

6. The method for severing a perforated web as recited in claim 1, wherein the step of inflating further comprises using compressed air to expand the tensioning member.

7. An apparatus for severing a perforated web comprising:

two clamping members positioned on one side of the web, said two clamping members being aligned substantially transversely to the web;

an anvil positioned on an opposite side of the web with respect to the two clamping members, said two clamping members being movable into engagement with the web to clamp the web against the anvil;

tensioning means for severing the web at perforations thereof, said tensioning means being positioned between the two clamping members and being inflatable to expand and contact the web proximate a perforation located between the clamping members to thereby sever the web, said tensioning means only severing the web at the perforation while being clamped by the clamping members when the tensioning means is inflated; and a backing bight positioned on an opposite side of the web with respect to the tensioning means, said tensioning means expanding into the backing bight upon inflation thereof.

8. The apparatus for severing a perforated web as recited in claim 7, wherein the backing bight is positioned between the clamping members and on the same side of the web as the clamping members.

9. The apparatus for severing a perforated web as recited in claim 8, wherein the tensioning means is positioned in a seat defined in the anvil.

10. The apparatus for severing a perforated web as recited in claim 7, wherein the tensioning means is positioned in a seat defined in the anvil.

11. The apparatus for severing a perforated web as recited in claim 7, wherein the backing bight is defined in the anvil.

12. The apparatus for severing a perforated web as recited in claim 11, wherein the tensioning means is positioned between the clamping members and on the same side of the web as the clamping members.

13. The apparatus for severing a perforated web as recited in claim 7, wherein the tensioning means is positioned between the clamping members and on the same side of the web as the clamping members.

14. The apparatus for severing a perforated web as recited in claim 7, wherein the web is paper and wherein the two clamping members are positioned a predetermined distance from each other to ensure positioning of a perforation of the paper web therebetween when said two clamping members move into engagement with the web to clamp the web against the anvil thereby avoiding a need for precise alignment of the web.

15. The apparatus for severing a perforated web as recited in claim 7, wherein the two clamping members are rigid members.

16. The apparatus for severing a perforated web as recited in claim 7, wherein the two clamping members are inflatable hoses.

17. The apparatus for severing a perforated web as recited in claim 7, wherein the means for tensioning comprises an inflatable hose.

* * * * *